US007138766B2

(12) United States Patent
Takeuchi et al.

(10) Patent No.: US 7,138,766 B2
(45) Date of Patent: Nov. 21, 2006

(54) DIMMABLE METAL HALIDE LAMP AND LIGHTING METHOD

(75) Inventors: Nobuyoshi Takeuchi, Ibaraki (JP); Takashi Maniwa, Takatsuki (JP); Yoshiharu Nishiura, Outsu (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 10/918,636

(22) Filed: Aug. 13, 2004

(65) Prior Publication Data

US 2005/0073257 A1 Apr. 7, 2005

(30) Foreign Application Priority Data

Aug. 29, 2003 (JP) ..... 2003-307780
Aug. 4, 2004 (JP) ..... 2004-227975

(51) Int. Cl.
*H01J 61/12* (2006.01)

(52) U.S. Cl. ..... 313/643; 313/637; 313/638

(58) Field of Classification Search ..... 313/637–643
See application file for complete search history.

(56) References Cited

U.S. PATENT DOCUMENTS 4,808,876 A * 2/1989 French et al. ..... 313/25
5,239,232 A * 8/1993 Heider et al. ..... 313/639
5,363,007 A * 11/1994 Fromm et al. ..... 313/25
6,469,446 B1 * 10/2002 Stockwald ..... 313/638
6,661,173 B1 * 12/2003 Koenigsberg et al. ..... 313/634
6,717,364 B1 4/2004 Zhu et al. ..... 313/642
6,724,145 B1 * 4/2004 Muto et al. ..... 313/638
2002/0185979 A1 * 12/2002 Jackson et al. ..... 313/642
2004/0080938 A1 * 4/2004 Holman et al. ..... 362/231
2004/0217710 A1 * 11/2004 Zhu et al. ..... 313/639
2004/0263080 A1 * 12/2004 Brates et al. ..... 313/634

FOREIGN PATENT DOCUMENTS

JP 2002-42728 2/2002

* cited by examiner

*Primary Examiner*—Joseph Williams
*Assistant Examiner*—Bumsuk Won

(57) ABSTRACT

A metal halide lamp in which an arc tube is housed within a bulb having a base at one end thereof. The arc tube includes a main tube, two thin tubes that extend one from each end of the main tube, and a pair of electrode inductors. The main tube and the thin tubes are made from translucent polycrystalline alumina and constitute a discharge vessel having a discharge space therein. Lamp power under dimming conditions is set in a range defined by maximum lamp power Wmax [W] and minimum lamp power Wmin [W], with a surface area S [$cm^2$] of the inner surface of the discharge vessel satisfying $Wmax/60 \leqq S \leqq Wmin/20$.

20 Claims, 16 Drawing Sheets

FIG.3

CHANGE IN CHARACTERISTICS UNDER DIMMING CONDITIONS (100 HRS)

| VOLTAGE (V) | CURRENT (A) | LAMP PWR (W) | TOT. LUM. FLUX (lm) | LAMP EFFIC. (lm/W) | COL. TEMP. (K) | Duv | CRI (Ra) |
|---|---|---|---|---|---|---|---|
| 88.0 | 1.704 | 150.0 | 13515 | 90.1 | 3615 | -1.9 | 86 |
| 90.1 | 1.998 | 180.0 | 16578 | 92.1 | 3600 | -2.2 | 88 |
| 95.7 | 2.194 | 210.0 | 19257 | 91.7 | 3575 | -2.3 | 92 |
| 97.8 | 2.301 | 225.0 | 20588 | 91.5 | 3555 | -2.8 | 93 |

FIG.5

| SURFACE AREA S ($cm^2$) | BULB WALL LDG ($W/cm^2$) | LAMP CHAR. | LIFE CHAR. |
|---|---|---|---|
| 9.00 | 25(15) | × | △ |
| 7.50 | 30(18) | △ | ○ |
| 6.82 | 33(20) | ○ | ◎ |
| 5.63 | 40(24) | ◎ | ◎ |
| 5.00 | 45(27) | ◎ | ◎ |
| 4.50 | 50(30) | ◎ | ◎ |
| 4.09 | 55(33) | ◎ | ○ |
| 3.75 | 60(36) | ○ | ○ |
| 3.46 | 65(39) | ○ | × |
| 3.21 | 70(42) | △ | × |

FIG.8

CHANGE IN CHARACTERISTICS UNDER DIMMING CONDITIONS (100 HRS)

| VOLTAGE (V) | CURRENT (A) | LAMP PWR (W) | TOT. LUM. FLUX (lm) | LAMP EFFIC. (lm/W) | COL. TEMP. (K) | Duv | CRI (Ra) |
|---|---|---|---|---|---|---|---|
| 120 | 2.25 | 270 | 35400 | 131.1 | 4095 | 18 | 72 |
| 123 | 2.44 | 300 | 39900 | 133.0 | 4100 | 19 | 74 |
| 128 | 2.73 | 350 | 47000 | 134.3 | 4125 | 21 | 76 |
| 133 | 3.01 | 400 | 54000 | 135.0 | 4155 | 23 | 78 |

FIG.11

TYPE 1

| VOLTAGE (V) | CURRENT (A) | LAMP PWR (W) | TOT. LUM. FLUX (lm) | LAMP EFFIC. (lm/W) | COL. TEMP. (K) | Duv | CRI (Ra) |
|---|---|---|---|---|---|---|---|
| 91.2 | 1.61 | 146.4 | 13967 | 95.4 | 4248 | -3.5 | 96.4 |
| 77.5 | 1.17 | 90.55 | 7859 | 86.8 | 4298 | -4.0 | 85.9 |

FIG.13

TYPE 2

| VOLTAGE (V) | CURRENT (A) | LAMP PWR (W) | TOT. LUM. FLUX (lm) | LAMP EFFIC. (lm/W) | COL. TEMP. (K) | Duv | CRI (Ra) |
|---|---|---|---|---|---|---|---|
| 92.7 | 1.59 | 147.0 | 14358 | 97.7 | 3084 | -7.1 | 93 |
| 83.6 | 1.08 | 90.5 | 8521 | 94.1 | 2875 | -6.0 | 77 |

FIG.14

TYPE 1 EQUIVALENT

| VOLTAGE (V) | CURRENT (A) | LAMP PWR (W) | TOT. LUM. FLUX (lm) | LAMP EFFIC. (lm/W) | COL. TEMP. (K) | Duv | CRI (Ra) |
|---|---|---|---|---|---|---|---|
| 91.7 | 1.62 | 148.0 | 13600 | 91.9 | 4083 | -3.3 | 97 |
| 78.2 | 1.16 | 90.3 | 7835 | 86.8 | 4409 | 1.2 | 86 |

FIG.15

TYPE 2 EQUIVALENT

| VOLTAGE (V) | CURRENT (A) | LAMP PWR (W) | TOT. LUM. FLUX (lm) | LAMP EFFIC. (lm/W) | COL. TEMP. (K) | Duv | CRI (Ra) |
|---|---|---|---|---|---|---|---|
| 97.4 | 1.53 | 148.6 | 13750 | 92.5 | 2993 | -5.5 | 94 |
| 87.7 | 1.04 | 90.7 | 8350 | 92.1 | 2953 | 0.1 | 79 |

FIG.16

| No. | VOLTAGE (V) | CURRENT (A) | LAMP PWR (W) | TOT. LUM. FLUX (lm) | LAMP EFFIC. (lm/W) | COL. TEMP. (K) | Duv | CRI (Ra) | $M_{T/C}$ |
|---|---|---|---|---|---|---|---|---|---|
| TYPE 3 | 94.0 | 1.54 | 144.5 | 14695 | 101.7 | 4431 | 1.6 | 94 | 0.4 |
| | 80.6 | 1.12 | 90.4 | 8260 | 91.4 | 4010 | -6.4 | 82 | |
| TYPE 4 | 95.7 | 1.54 | 146.8 | 14011 | 95.5 | 4527 | 3.8 | 97 | 1.0 |
| | 80.1 | 1.13 | 90.1 | 8071 | 89.6 | 4575 | 1.6 | 86 | |
| TYPE 5 | 93.0 | 1.58 | 146.3 | 14102 | 96.4 | 4267 | -0.3 | 97 | 2.6 |
| | 79.5 | 1.14 | 90.1 | 8014 | 89.0 | 4378 | -1.3 | 86 | |
| TYPE 6 | 92.4 | 1.60 | 147.7 | 14860 | 100.6 | 3199 | -6.4 | 93 | 3.5 |
| | 82.8 | 1.09 | 90.1 | 8668 | 96.2 | 2918 | -4.0 | 76 | |
| TYPE 7 | 87.8 | 1.65 | 145.1 | 13854 | 95.5 | 3049 | -5.3 | 92 | 5.8 |
| | 80.7 | 1.123 | 90.5 | 8308 | 91.8 | 2911 | -0.5 | 75 | |

FIG.17

| (H total-3)/V | DIMMING CHAR. | LAMP EFF. (150W) |
|---|---|---|
| -0.5 | × | 85(△) |
| 0.9 | ○ | 91(○) |
| 2.4 | ○ | 89(○) |
| 3.8 | ◎ | 88(○) |
| 5.2 | ◎ | 86(○) |
| 6.3 | ◎ | 82(×) |

FIG.18

| (H total-3)/V | DIMMING CHAR. | LAMP EFF. (150W) |
|---|---|---|
| -0.5 | △ | 90(○) |
| 0.9 | ○ | 92(◎) |
| 2.4 | ○ | 91(○) |
| 3.8 | ◎ | 90(○) |
| 5.2 | ◎ | 87(○) |
| 6.3 | ◎ | 82(×) |

DIMMABLE METAL HALIDE LAMP AND LIGHTING METHOD

This application is based on applications no.2003-307780 and no.2004-227975 filed in Japan, the content of which is hereby incorporated by reference.

BACKGROUND OF THE INVENTION

1. Field of the Invention

The present invention relates to metal halide lamps and lighting methods for the same.

2. Related Art

A metal halide lamp includes an arc tube formed from a discharge vessel having a discharge space therein and constituted from a main tube and two thin tubes that extend one from each end of the main tube, and a pair of electrode inductors that are sealed one within each thin tube so that respective ends of the inductors are opposed in the discharge space. A light-emitting material, a buffer gas, and a starting rare gas are enclosed within the arc tube. The light-emitting material is formed from halides such as dysprosium iodide ($DyI_3$), thulium iodide ($TmI_3$), holmium iodide ($HoI_3$), thallium iodide (TlI) and the like, while the buffer gas is formed from mercury and the starting rare gas is formed from argon and the like.

The discharge vessel is made from a translucent ceramic material, since this increases the heat resistance of the arc tube above that of conventional arc tubes made from quartz glass, and also because of the favorable lamp properties that are obtained such as high lamp efficiency, high color rendering, and long life.

In recent years, investigations into the operation under dimming conditions of metal halide lamps using a ceramic discharge vessel have been conducted with a view to reducing energy consumption. However, when a metal halide lamp with a ceramic discharge vessel is operated at low lamp power under dimming conditions, the lamp properties deteriorate markedly in comparison to operation at high lamp power, making the lamp impractical. Note that in the present invention, a lamp is defined as being impractical if either the color temperature differential or the Duv (deviation from blackbody locus×1000) differential under dimming conditions at minimum and maximum lamp power is ≧750 K and ≧7, respectively.

That is, the concentration of light-emitting material, buffer gas, argon and the like enclosed in the arc tube is designed for dimmed lighting at high lamp power. Thus, the vapor pressures of the halides (TlI, $DyI_3$, $TmI_3$, $HoI_3$) constituting the light-emitting material when the lamp is operated at high lamp power are well balanced, allowing an ideal emission spectrum to be obtained. However, when the lamp is operated at low lamp power, there is only a slight reduction in the vapor pressure of TlI in contrast to the marked drop in the vapor pressures of the rare-earth metal iodides ($DyI_3$, $TmI_3$, $HoI_3$). Consequently, the strong emission spectrum obtained for the Tl emission causes a change in color temperature, while the weaker emission spectrums obtained for the rare earth metals cause a deterioration in lamp efficiency.

In view of this, a metal halide lamp has been proposed that equalizes the drop in vapor pressure of the halides during low lamp power operation by replacing TlI (exhibiting only a slight drop in vapor pressure under low lamp power conditions) with $MgI_2$ (magnesium iodide), which has almost the same vapor pressure change as rare-earth metal halides such as $DyI_3$, $TmI_3$, $HoI_3$. This enables excellent color rendering to be obtained even when the lamp is operated at low lamp power (see, for example, Japanese Published Patent Application No. 2002-42728).

However, with metal halide lamps having $MgI_2$ enclosed therein, lamp life is shortened due to the high reactivity of the $MgI_2$ with the translucent ceramic material constituting the discharge vessel, making these lamps not really practical for dimmed lighting.

SUMMARY OF THE INVENTION

The present invention, which arose in view of the above problem, aims to provide a metal halide lamp that exhibits little change in lamp properties even when operated under dimming conditions, and a lighting method for the same.

To achieve this object, a dimmable metal halide lamp pertaining to the present invention is constituted from: an arc tube that includes a translucent ceramic discharge vessel and two electrodes held in a discharge space that exists within the discharge vessel and has a plurality of halides enclosed therein; and a base that feeds power to the electrodes. Also, a surface area S [$cm^2$] of an inner surface of the discharge vessel satisfies $Wmax/60 \leqq S \leqq Wmin/20$, when lamp power under dimming conditions is set in a range defined by maximum lamp power Wmax [W] and minimum lamp power Wmin [W].

This configuration stipulates a predetermined range of the surface area of the inner surface of the discharge vessel. With this metal halide lamp, there is little change in lamp properties even when operated under dimming conditions, making the lamp fully usable even under dimming conditions.

Here, $0 < Wmin/Wmax \leqq 0.7$ may be satisfied.

Here, the discharge vessel may include a main tube and two thin tubes that extend one from each end of the main tube, the electrodes may each be included within a different electrode inductor that is partly sealed in a respective one of the thin tubes by a sealing material, and a discharge-space end of a section of each thin tube corresponding to where the sealing material is disposed may be structured to have an external surface temperature of ≦900° C. when the lamp is operated at Wmax.

Here, the halides may be light-emitting materials other than mercury, and may be enclosed within the discharge space at a concentration that satisfies $0.9 \leqq (H_{total}-3)/V \leqq 5.2$, where $H_{total}$ [mg] is the halide concentration and V [$cm^3$] is the volume of the discharge space.

Here, the halides may include sodium halide, cerium halide, thallium halide, and at least one selected from the group consisting of dysprosium halide, holmium halide, thulium halide, gadolinium halide, and erbium halide.

Here, $1.0 \leqq M_{T/C} \leqq 3.5$ may be satisfied, where $M_{T/C}$ is a ratio of the thallium halide concentration [mol] to the cerium halide concentration [mol].

Here, a ratio of the cerium halide concentration to the total halide concentration may be <4.0 mol %.

Here, the metal halide lamp may be used as a white light source.

Here, Wmax may be 150 W and Wmin may be 90 W.

The above object is also achieved by a lighting method for operating a metal halide lamp under dimming conditions, the lamp including an arc tube in which two electrodes are held facing one another within a translucent ceramic discharge vessel, and lamp power being fed to the lamp so as to satisfy $WLmin \geqq 20$ and $WLmax \leqq 60$, where WLmin and WLmax are respectively a bulb wall loading [W/cm$^2$] of the arc tube at minimum and maximum lamp power under dimming conditions.

BRIEF DESCRIPTION OF THE DRAWINGS

These and other objects, advantages, and features of the invention will become apparent from the following description thereof taken in conjunction with the accompanying drawings, which illustrate specific embodiments of the present invention.

In the drawings:

FIG. 3 shows the change in characteristics of the lamp pertaining to embodiment 1 under dimming conditions;

FIG. 5 shows lamp characteristics and life characteristics for different bulb wall loadings;

FIG. 8 shows the change in characteristics of the lamp pertaining to embodiment 2 under dimming conditions;

FIG. 11 shows the change in characteristics of the lamp pertaining to embodiment 3 under dimming conditions;

FIG. 13 shows the change in characteristics of the lamp pertaining to embodiment 3 under dimming conditions;

FIG. 14 shows the change in characteristics of a lamp equating to the lamp pertaining to embodiment 3 under dimming conditions;

FIG. 15 shows the change in characteristics of a lamp equating to the lamp pertaining to embodiment 3 under dimming conditions;

FIG. 16 shows the dimming characteristics (after 100 hrs operation) for different $M_{T/C}$ values;

FIG. 17 shows the change in characteristics under dimming conditions in relation to the halide concentration; and FIG. 18 shows the change in characteristics under dimming conditions in relation to the halide concentration.

DETAILED DESCRIPTION OF THE PREFERRED EMBODIMENTS

Metal halide lamps are described below as embodiments of the present invention, with reference to the drawings.

Embodiment 1

Figure 1:
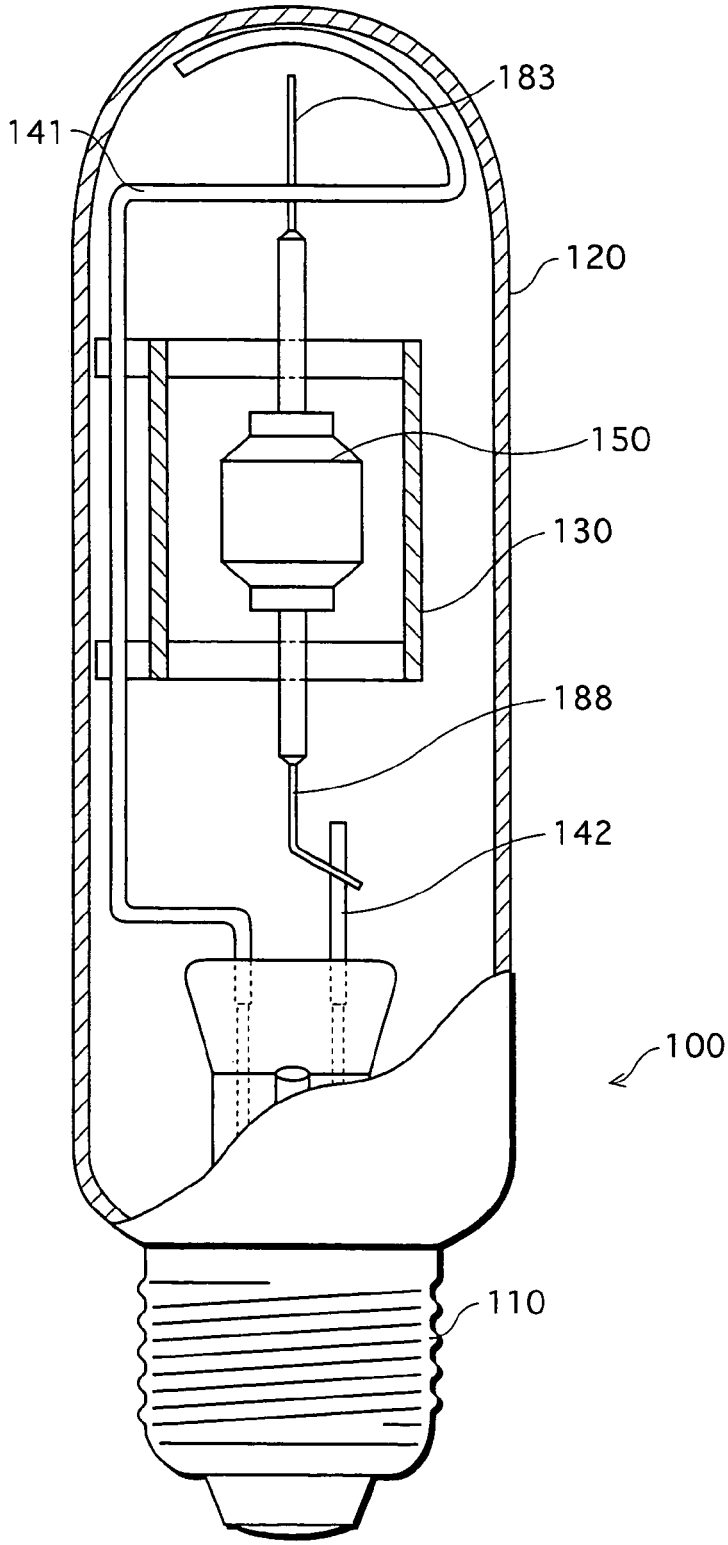
FIG. 1 is a partial cutaway view of a metal halide lamp pertaining to an embodiment 1.

FIG. 1 is a partial cutaway view of a metal halide lamp pertaining to embodiment 1.

Metal halide lamp 100 (hereinafter, simply "lamp 100") is dimmable within a lamp power range of 150 W to 225 W, and may be used, for example, as an interior light for shops, displays, exhibitions, and the like. With such applications, importance is attached to lamp efficiency and color characteristics, and a so-called white light source (CRI: ≧80, preferably ≧90; Duv: +2~−10) preferably is employed.

1. Structure

In lamp 100, as shown in FIG. 1, an arc tube 150 is housed within a bulb 120 that also includes a base 110 (e.g. E26 base). A quartz shielding tube 130 that surrounds arc tube 150 and protects bulb 120 from damage is provided within bulb 120.

Bulb 120 is made from hard glass, for example, and has nitrogen, for example, enclosed therein. Note that the space within the bulb may be a vacuum.

Lamp 100 is turned on upon power being fed from base 110, as a result of feeders 183 and 188 (described below), which lead out one from either end of arc tube 150, being electrically connected to stem wires 141 and 142, which are connected to base 110. Note that stem wires 141 and 142 generally consist of an integrated number of connected wires.

Arc tube 150 is described next.

Figure 2:
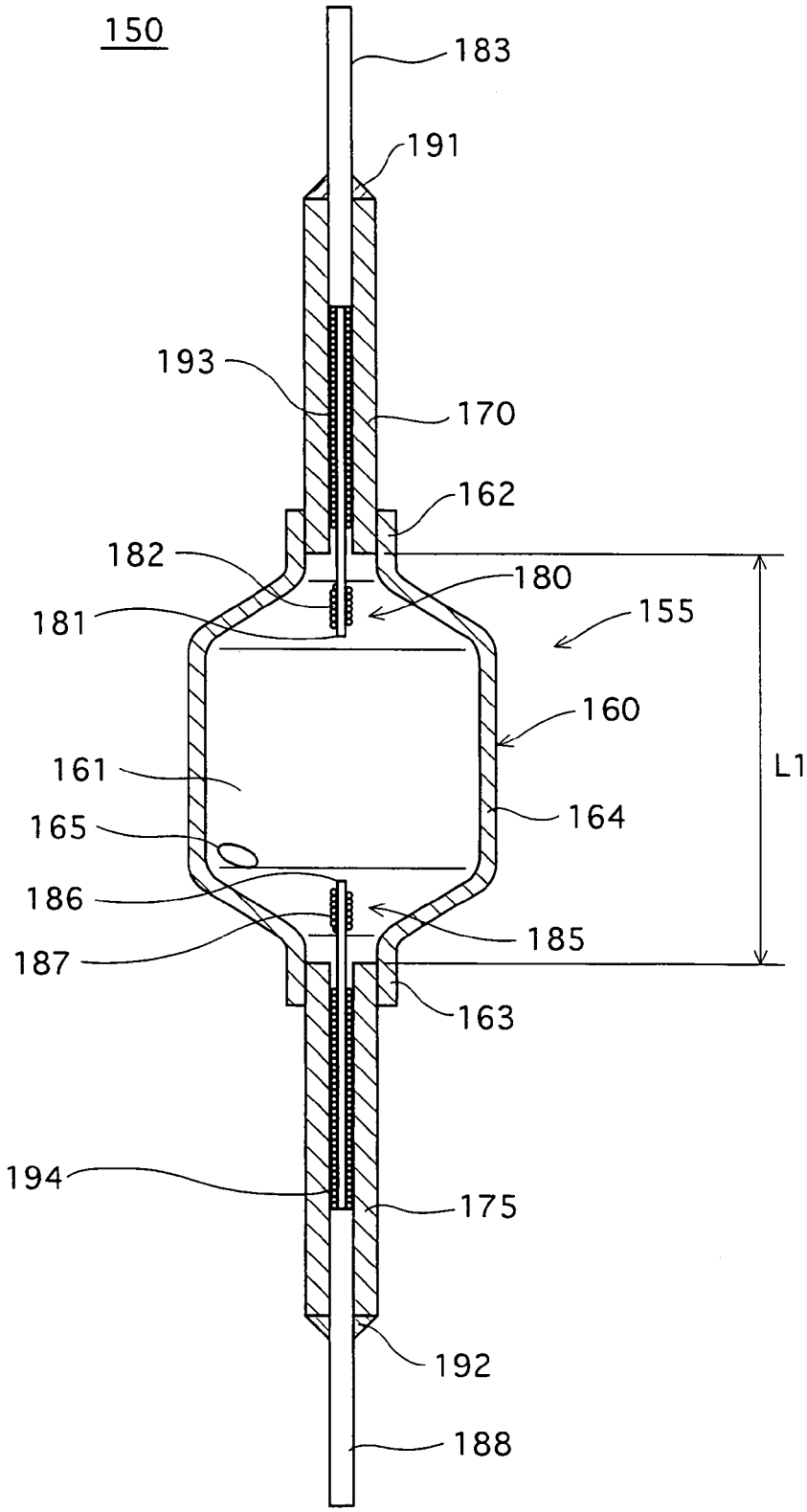
FIG. 2 is a longitudinal sectional view of an arc tube pertaining to embodiment 1.

FIG. 2 is a longitudinal sectional view of arc tube 150.

Arc tube 150 has, as shown in FIG. 2, a main tube 160 forming a discharge space 161 therein, thin tubes 170 and 175 provided at end sections 162 and 163 of main tube 160, and a pair of electrode inductors 180 and 185. Note that thin tubes 170 and 175 are provided in main tube 160 so that the central axes of the thin tubes are substantially aligned with the central axis of the main tube.

Main tube 160 and thin tubes 170 and 175 are integrally formed from translucent polycrystalline alumina (97% total transmittance). The translucent polycrystalline alumina has a heat resistance of approximately 1200° C., which is around 200° C. higher than the heat resistance (approx. 1000° C.) of the quartz glass conventionally used.

Thin tubes 170 and 175 are sintered to end sections 162 and 163 of main tube 160. Main tube 160 and thin tubes 170 and 175 together constitute a discharge vessel 155. As shown in FIG. 2, a middle section 164 of main tube 160 has a cylindrical major diameter, with the diameter gradually decreasing from the ends of middle section 164 toward end sections 162 and 163. Thin tubes 170 and 175 both have a straight cylindrical shape.

Electrode inductors 180 and 185 are formed from electrode rods 181 and 186, coils 182 and 187 wound around the ends of electrode rods 181 and 186 on the discharge-space side, and feeders 183 and 188 joined to the ends of electrode rods 181 and 186 opposite the discharge-space side. Note that tungsten is used in electrode rods 181/186 and coils 182/187, while conductive cermet is used in feeders 183/188.

Here, the combination of electrode rod 181 with coil 182 and electrode rod 186 with coil 187 are referred to as electrodes, the ends of the electrodes being disposed in discharge space 161 so as to be substantially opposed to one another.

Electrode inductors 180 and 185 are inserted into thin tubes 170 and 175 from the end at which coil 182 and 185 are disposed, and held in thin tubes 170 and 175 by airtight sealing a section of feeders 183 and 188 in thin tubes 170 and 175 using a sealing material (e.g. frits 191, 192). Note that frits 191 and 192 used in the frit seal have a $Dy_2O_3$—$Al_2O_3$—$SiO_2$ composition.

Molybdenum coils 193 and 194 for preventing a light-emitting material (described below) from encroaching into the respective gaps between the electrode rods and thin tubes is inserted into the gaps, so as to be wound around electrode rods 181 and 186.

Predetermined concentrations of a light-emitting material 165 made from halides (e.g. $DyI_3$, $TmI_3$, $HoI_3$, TlI, and sodium iodide or "NaI"), mercury (as a buffer gas), and argon (as a starting rare gas) are enclosed in discharge space 161 of arc tube 150.

A specific example of arc tube 150 having the above structure is given here.

Firstly, with arc tube 150, a bulb wall loading WLmax and a bulb wall loading WLmin are set to fall within a predetermined range (given below). Here, WLmax is the bulb wall loading when lamp 100 operated under dimming conditions at maximum lamp power Wmax, and WLmin is the bulb wall loading when lamp 100 is operated under dimming conditions at minimum lamp power Wmin. Bulb wall loading WL is calculated using the equation WL=Wi/S, where Wi [W] is lamp power and S [$cm^2$] is the surface area of the inner surface of discharge vessel 161.

The measurements of arc tube 150 are determined based on surface area S of the inner surface of discharge vessel 16, which is itself determined so that bulb wall loading WL takes a value that satisfies the predetermined range. Note that bulb wall loading WLmax (WLmin) is a numerical value obtained by dividing lamp power Wmax (Wmin) by surface area S.

Exemplary measurements of arc tube 150 are given below.

Arc tube 150 is housed within bulb 120, and nitrogen is enclosed within the bulb at 56.5 kPa.

With arc tube 150, bulb wall loading WLmax at Wmax (here, 225 W) is set to 41 W/$cm^2$, and bulb wall loading WLmin at Wmin (here, 150 W) is set to 27 W/$cm^2$. The measurements of discharge vessel 155 within which discharge space 161 is to be formed are determined so that surface area S of the inner surface of discharge vessel 161 at this time is approximately 5.5 $cm^2$.

The total length of discharge vessel 155 is 44 mm. With main tube 160, the inner and outer diameters of middle section 164 are respectively 10 mm and 11.4 mm, and the distance (L1 in FIG. 2) between thin tubes 170 and 175 on either side of main tube 160 is 15 mm. Thin tubes 170 and 175 each have an outer diameter of 3.0 mm, an inner diameter of 1.0 mm, and a total length of 14.5 mm.

Note that with discharge vessel 155 of the present embodiment, discharge space 161 is defined by the distance, within main tube 160, between the end faces of thin tubes 170 and 175 (i.e. the distance L1 in FIG. 2), and does not include the holes in thin tubes 170 and 175.

The principal measurements of electrode inductors 180 and 185 are described next. Electrode inductors 180 and 185 are held in thin tubes 170 and 175 so that the distance between electrode rods 181 and 186 within discharge space 161 is 10 mm. Electrode rods 181 and 186 have an outer diameter of 0.5 mm and a total length of 12.5 mm, while feeders 183 and 188 have an outer diameter of 0.9 mm and a total length of 12 mm. The frit sealed sections of electrode inductors 180 and 185 (i.e. sections corresponding to where frits 191 and 192 are disposed) each has a total length along the respective thin tube of 4.5 mm.

Light-emitting material 165 is enclosed within discharge space 161 at 5 mg. The halides constituting light-emitting material 165 are given below, together with the respective concentrations expressed in mole percent:

$DyI_3$:$TmI_3$:$HoI_3$:TlI:NaI=6.6:4.8:6.5:8.5:73.5 mol %

2. Dimming Characteristics

The following description relates to lamp 100, which includes arc tube 150 having the above specific structure, being operated under dimming conditions in a range defined by minimum lamp power Wmin of 150 W and maximum lamp power Wmax of 225 W.

FIG. 3 shows measurement results for total luminous flux, lamp efficiency, color temperature, CRI (general color rendering index), and Duv (deviation from blackbody locus× 1000) when lamp 100 is operated under dimming conditions in a lamp power range of 150 W to 225 W.

Total luminous flux, as evident from FIG. 3, fluctuates (increases/decreases) with fluctuations in lamp power, while lamp efficiency remains substantially constant (90.1 lm/W~91.5 lm/W), irrespective of changes in lamp power.

With conventional metal halide lamps, significant changes in color temperature (≧750 K) result from changes in lamp power when the lamp is operated under dimming conditions. However, with lamp 100 having the above structure, FIG. 3 clearly shows that color temperature remains substantially constant, irrespective of changes in lamp power. Specifically, the color temperature differential between lamp operation at Wmax (3555 K) and Wmin (3615 K) is 60 K, which represents a huge improvement over the prior art.

CRI (86~93 Ra) and Duv (−1.9~−2.8) are both substantially constant even at low lamp power, with CRI remaining at or above 86 Ra and the Duv value being extremely small.

Note that, strictly speaking, the above values for lamp efficiency and color temperature fluctuate respectively by around 1.5% and 1.7% following changes in lamp power. However, the lamp is fully usable with this degree of fluctuation, and no problems arise in actual use. Note also that these fluctuation ranges are absolute values obtained by dividing the difference between the lamp power values by a reference value, the reference in this case being lamp operation at maximum lamp power (Wmax).

These measurement results reveal that with lamp 100 set to the above bulb wall loading WL, operation in an excellent state under dimming conditions is possible within a lamp power range of 150 W to 225 W, while exhibiting minimal change in lamp properties (e.g. lamp efficiency, color temperature, color rendering, etc.).

The life characteristics of the lamp when operated under dimming conditions in a lamp power range of 150 W to 225 W are described next.

Figure 4:
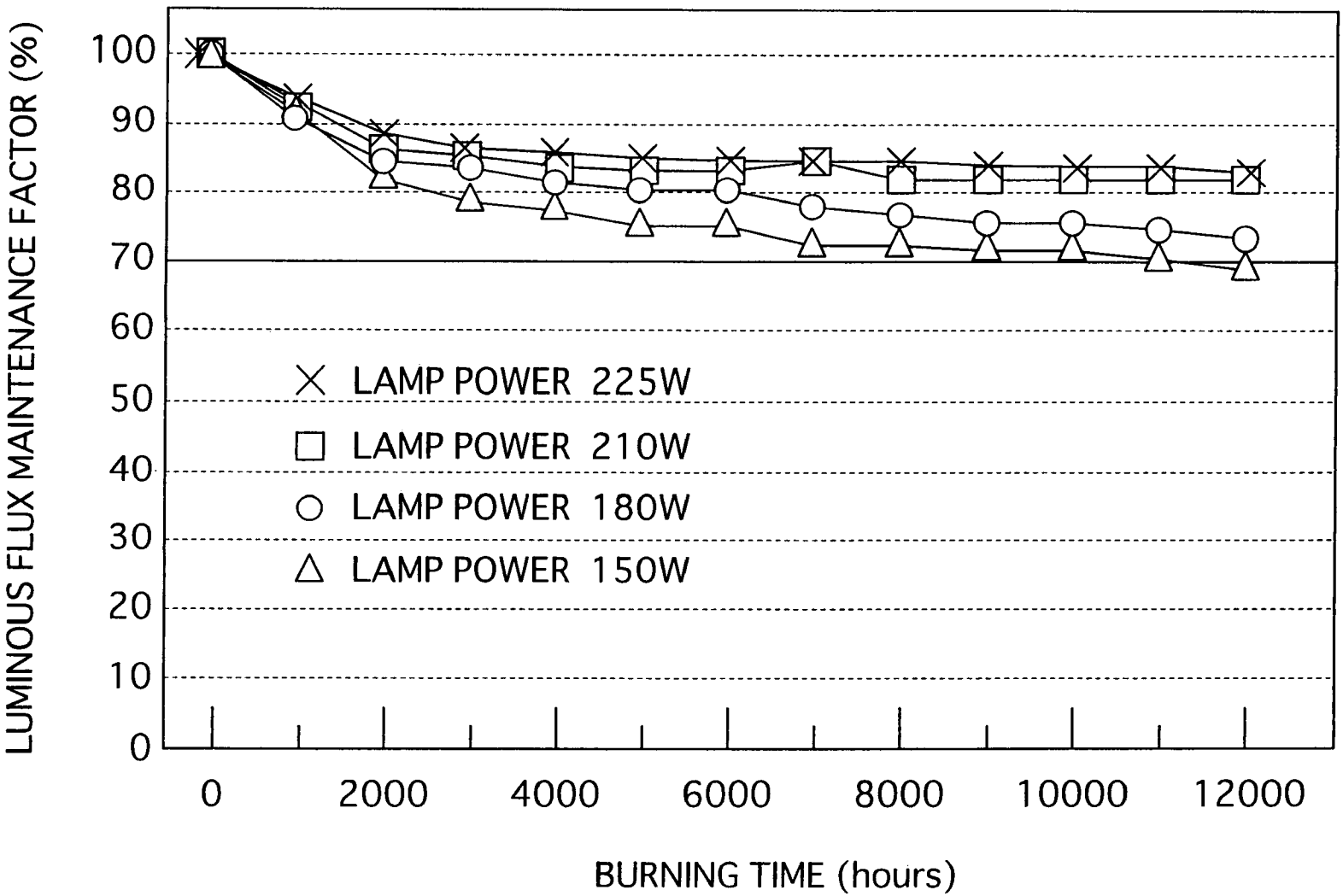
FIG. 4 shows the luminous flux maintenance factor for different lamp power values, using the lamp pertaining to embodiment 1.

FIG. 4 shows the relation between burning time and the luminous flux maintenance factor for life tests carried out at lamp power values of 150 W, 180 W, 210 W and 225 W, using lamp 100 having the above structure.

Note that the life tests involved repeated ON/OFF cycles of 5.5 hours ON and 0.5 hours OFF respectively, with the luminous flux value after 100 hours burning being used as the initial value for calculating the luminous flux maintenance factor. Lamp life in the above ON/OFF cycle tests was defined by the accumulated ON-time at the point at which the luminous flux maintenance factor reached 70% of the initial value.

The test results, as shown in FIG. 4, reveal that the luminous flux maintenance factor is maintained at an excellent level for all of the lamp power values, while the shortening of lamp life seen with conventional metal halide lamps when operated at low lamp power under dimming conditions was not observed.

The above tests shows that it is possible, with lamp 100 having the above structure, to prevent reductions in color temperature over the lamp power range under dimming conditions (i.e. bulb wall loading WL of 27.3 W/cm$^2$ at 150 W to 40.9 W/cm$^2$ at 225 W) without changing light-emitting material 165, and, moreover, that the luminous flux maintenance factor does not decrease greatly over the entire range of lamp power values under dimming conditions. Lamp 100 is thus considered to be fully usable as a dimmable lamp.

3. Tube-Wall Loading

With the development of metal halide lamps for dimmed lighting to date, it was thought that bulb wall loading WLmax is greatest and lamp life is shortest when the lamp is operated at Wmax under dimming conditions. That is, the conventional thinking was that lamp power is reduced and lamp life is extended with decreases in bulb wall loading WL.

However, having attempted to shorten the duration of life tests by increasing bulb wall loading WL, the inventors discovered that lamp life, rather than being shortened, actually increased. The inventors thus realized that by applying this principle to metal halide lamps, color temperature variation could be reduced even under dimming conditions.

As a result of conducting these investigations, it was discovered that with a lamp having the above structure, it was preferable to set bulb wall loading WL, when Wmax under dimming conditions is ≦250 W, in a range defined by bulb wall loading WLmin at Wmin of ≧20 W/cm$^2$ and bulb wall loading WLmax at Wmax of ≦60 W/cm$^2$.

The reasons for this are explained below.

Firstly, ten different samples were made, with surface area S of the inner surface of discharge vessel 161 in the samples being adjusted so that the bulb wall loading WLmax at Wmax increased in 5 W/cm$^2$ increments in a range of 25 W/cm$^2$ to 70 W/cm$^2$ when the lamp was operated under dimming conditions over a lamp power range of 135 W to 225 W. Each sample was operated under dimming conditions and tests were carried out into lamp efficiency, lamp characteristics (e.g. dimming characteristics, etc.), and life characteristics. Note that the tests relating to the lamp characteristics and life characteristics of the samples were conducted in the same manner as the above-mentioned tests on lamp 100 in which surface area S of the inner surface of discharge vessel 161 was 5.5 W/cm$^2$.

The test results from the ten samples are shown in FIG. 5.

FIG. 5 is described here. Firstly, two numerical values are shown in the bulb wall loading column, the first being the bulb wall loading value at Wmax, while the bracketed value is the bulb wall loading value at Wmin.

The lamp characteristics and life characteristics were evaluated using four grades: "X" "Δ" "○" "◎":

X bad
Δ not good (problems remain)
○ good (fully usable)
◎ excellent (a) Lamp Characteristics The lamp characteristics are described first.

FIG. 5 reveals that even when the lamp is operated under dimming conditions, excellent lamp characteristics ("◎") are obtained for bulb wall loading in a range of 40(24) to 55(33). Even for bulb wall loading in a range of 33(20) to 65(39), the lamp characteristics present no problems in terms of practical use (at least "○"), even when the lamp is operated under dimming conditions.

However, outside the bulb wall loading range of 33(20) to 65(39) (i.e. bulb wall loading: ≦30(18) or ≧70(42)), practical lamp characteristics are not obtained ("Δ" or "X").

The reasons for this are discussed briefly here.

Firstly, the "Δ" and "X" results at bulb wall loadings of ≦30 (18) are due to the temperature in discharge space 161 when the lamp is operated at Wmin (135 W) falling below that at Wmax (225 W). Because of the different vapor pressure characteristics of the halides enclosed within discharge space 161, this increases the difference in the lamp properties (lamp efficiency, color temperature, etc.) between operation at Wmax and Wmin.

On the other hand, the reason for the "Δ" result at bulb wall loadings of 70(42) and above is the deterioration in lamp efficiency and color temperature when the lamp is operated at Wmax, because of the loading being too high.

(b) Life Characteristics

The life characteristics are described next.

FIG. 5 reveals that excellent life characteristics ("◎") are obtained for bulb wall loading in a range of 33(20) to 50(30). Even for bulb wall loading in a range of 30 (18) to 60(36), the life characteristics obtained present no problems in terms of practical use (at least "○").

However, outside the bulb wall loading range of 30(18) to 60(36) (WL≦25(15), WL≧65(39)), practical lamp characteristics are not obtained ("Δ" or "X").

The reasons for this are discussed briefly here.

Firstly, the reason for the "Δ" result at bulb wall loadings of 25(15) and below is that the tube wall of discharge vessel 155 has a low temperature when the lamp is operated at Wmin. This inhibits the halogen cycle and causes the tube wall to be severely blackened.

On the other hand, the reason for the "X" result at bulb wall loadings of 65(39) and above is the rise in temperature of arc tube 150 when the lamp is operated at Wmax. This increases the reactivity of discharge vessel 155 and light-emitting material 165 within discharge vessel 155, and in the life tests, resulted in cracks appearing in main tube 160 of arc tube 150 within 3000 hours, causing lamp operation failure due to leaking.

(c) Summary

The above results show that the lamp and life characteristics for lamp 100 are both satisfied in a bulb wall loading range of 33 (20) to 60 (36). Note that this range may be referred to as the "optimal bulb wall loading range under dimming conditions".

Specifically, when Wmax under dimming conditions is ≦250 W, bulb wall loading WL under dimming conditions is set in a range defined by bulb wall loading WLmin at Wmin of ≧20 W/cm$^2$ and bulb wall loading WLmax at Wmax of ≦60 W/cm$^2$.

Note that tests have confirmed that substantially the same results are obtained for the above bulb wall loading range when nitrogen is enclosed within bulb 120 or when a vacuum is formed within the bulb.

Thus, with arc tube 150, if the dimmed lighting conditions (i.e. Wmax, Wmin) are set, surface area S of the inner surface of discharge vessel 161 preferably is determined so that bulb wall loading WL satisfies the above conditions, without being limited to the above-mentioned 5.5 cm$^2$.

Embodiment 2

Figure 6:
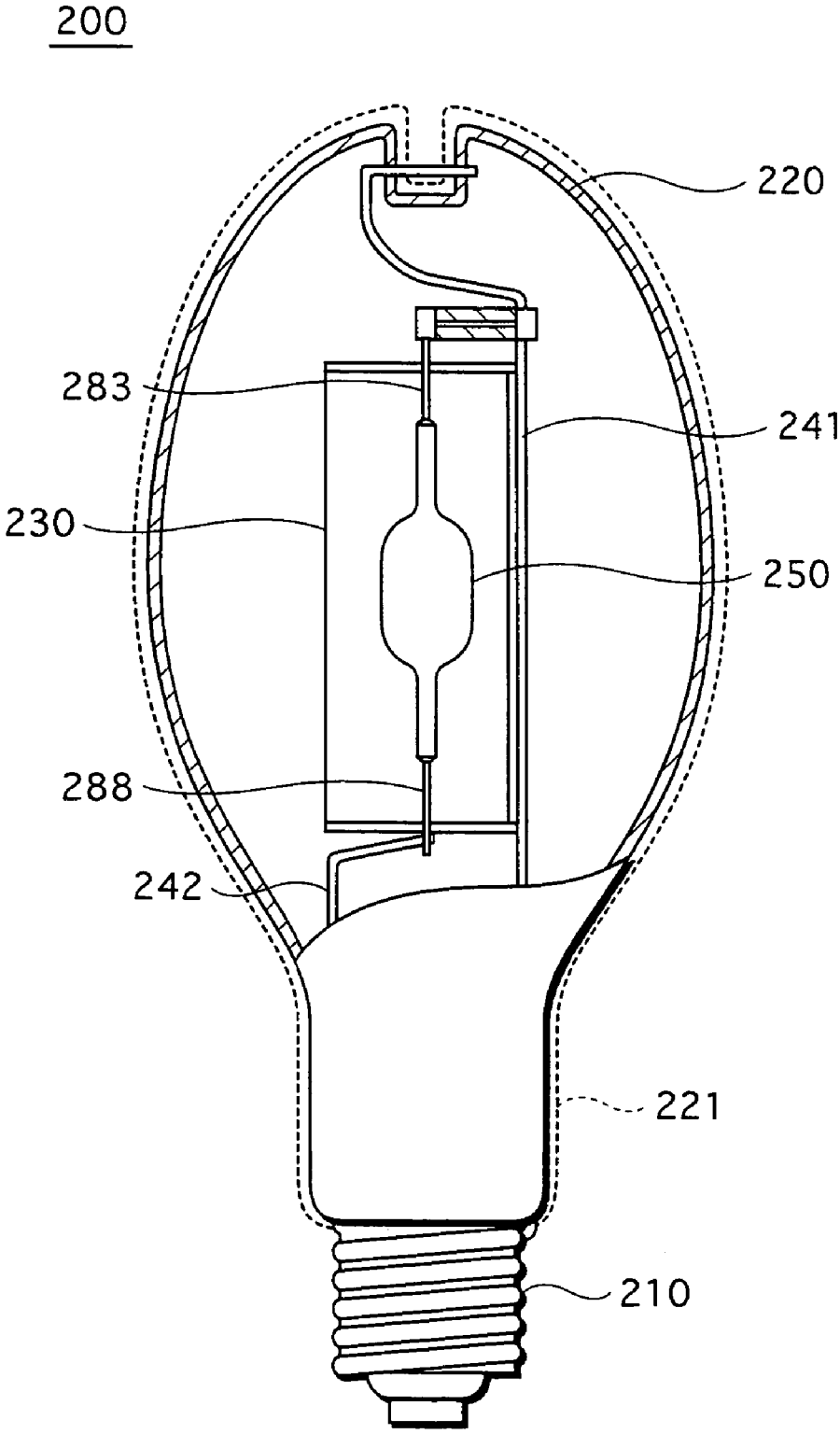
FIG. 6 is a partial cutaway view of a metal halide lamp pertaining to an embodiment 2.

FIG. 6 is a partial cutaway view of a metal halide lamp pertaining to embodiment 2.

Metal halide lamp 200 (hereinafter, simply "lamp 200") is dimmable within a lamp power range of 270 W to 400 W, and is, for example, for outdoor application (e.g. street lamps, etc.) or high-ceiling application (e.g. institutional facilities, gymnasiums, etc.). With such applications, importance is attached to lamp efficiency rather than color characteristics (CRI: approx. 50~70; Duv: approx. +10~+20).

1. Structure

With lamp 200, as shown in FIG. 6, an arc tube 250 is housed within a bulb 220 that also includes a base 210 (e.g. E39 base). As in embodiment 1, a quartz shielding tube 230 that encloses arc tube 250 is provided within bulb 220.

Bulb 220 is, for example, made from hard glass, with a vacuum formed within the bulb. Note that a film 221 (e.g. Teflon) is formed around the outside of bulb 220 to prevent glass shards from shattering in the event of breakage.

Power is fed to arc tube 250 from base 210 as a result of feeders 283 and 288, which protrude from the ends of the arc tube, being electrically connected to stem wires 241 and 242.

Arc tube 250 is described next.

Figure 7:
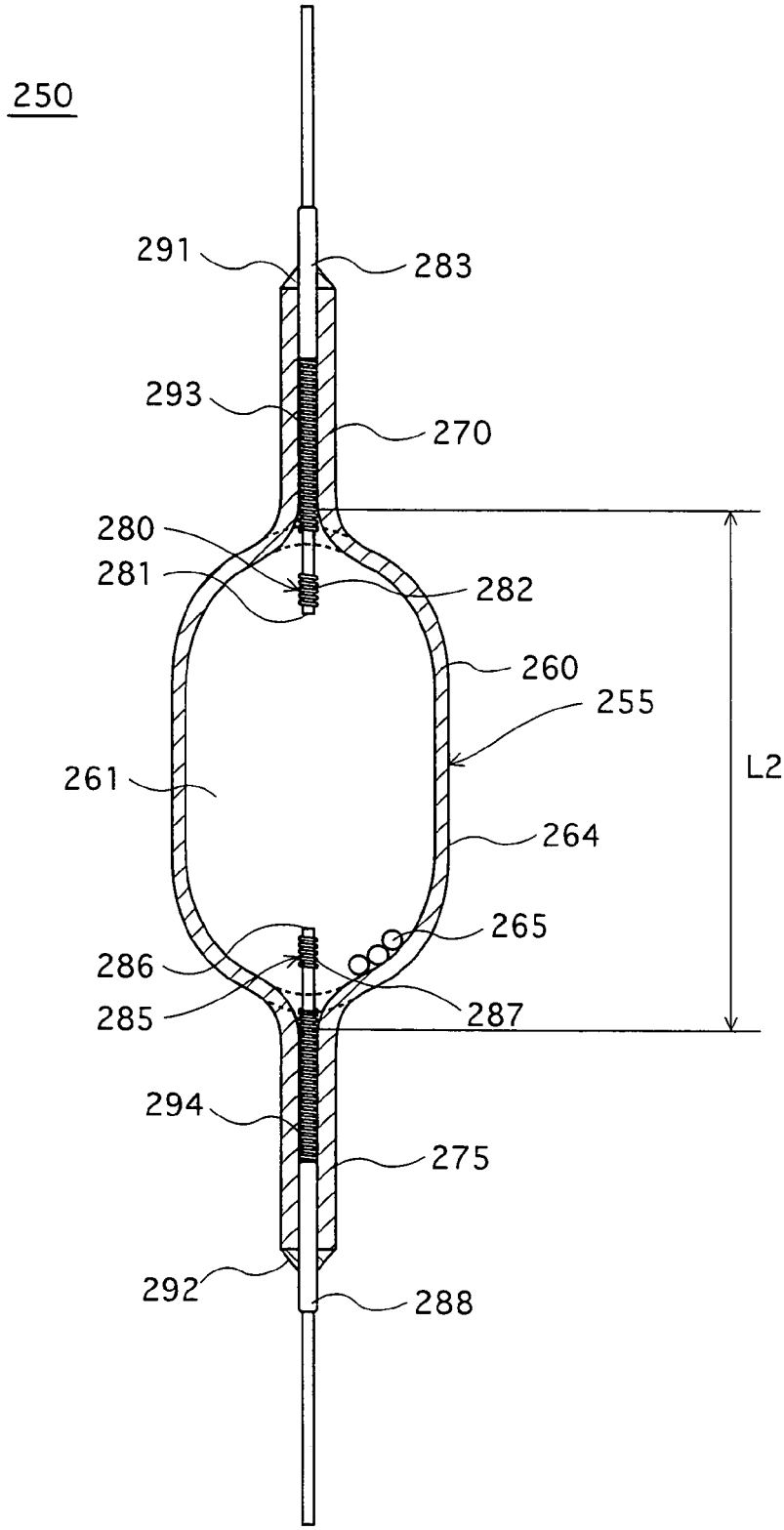
FIG. 7 is a longitudinal sectional view of an arc tube pertaining to embodiment 2.

FIG. 7 is a longitudinal sectional view of arc tube 250 pertaining to embodiment 2.

Arc tube 250, as shown in FIG. 7, includes a main tube 260 having a discharge space 261 formed therein, thin tubes 270 and 275 that extend one from either end of main tube 260, and a pair of electrode inductors 280 and 285.

Main tube 260 and thin tubes 270 and 275 are integrally formed from translucent polycrystalline alumina (97% total transmittance). The main and thin tubes together constitute a discharge vessel 255.

As shown in FIG. 7, main tube 260 is cylindrical in shape with the major diameter at a middle section 264, the diameter decreasing in an arc toward both ends. Thin tubes 270 and 275 have a straight cylindrical shape.

Electrode inductors 280 and 285 are, as in embodiment 1, formed from electrode rods 281 and 286, coils 282 and 287, and feeders 283 and 288. The material of these components is the same as embodiment 1.

With electrode inductors 280 and 285, a section of feeders 283 and 288 is airtight sealed within thin tubes 270 and 275 using, for example, frits 291 and 292, as in embodiment 1, so that the distance between electrode rods 281 and 286 in discharge space 261 is 30 mm.

Molybdenum coils 293 and 294 are, as in embodiment 1, disposed in the respective gaps between the electrode rods and thin tubes.

Enclosed within arc tube 250 is mercury, argon, and a light-emitting material 265 formed from halides (e.g. cerium iodide or $CeI_3$, indium iodide or $InI_3$, TlI, NaI).

A specific example of arc tube 250 having the above structure is described below.

With arc tube 250, bulb wall loading WLmax at Wmax (here, 400 W) is set to 37 W/cm$^2$, and bulb wall loading WLmin at Wmin (here, 270 W) is set to 25 W/cm$^2$. The measurements of discharge vessel 255 within which discharge space 261 is to be formed are determined so that surface area S of the inner surface of the discharge vessel at this time is approximately 10.8 cm$^2$.

The total length of discharge vessel 255 is 80 mm. The outer and inner diameters of main tube 260 at middle section 264 are 14.5 mm and 12 mm, respectively. Thin tubes 270 and 275 each have a 4 mm outer diameter, a 1.4 mm inner diameter, and a 20 mm total length.

Note that with discharge vessel 255 of the present embodiment, discharge space 261 is, as shown in FIG. 7, defined by the distance between the positions at which the discharge-space ends of thin tubes 270 and 275 begin to curve (i.e. the distance L2 in FIG. 7).

The principal measurements of electrode inductors 280 and 285 are described next. Electrode rods 281 and 286 have an outer diameter of 0.75 mm and a total length of 20 mm, while feeders 283 and 288 have an outer diameter of 1.3 mm and a total length of 10 mm. The frit-sealed sections of electrode inductors 280 and 285 each have a total length along the respective thin tube of 5 mm (i.e. length of section corresponding to where frit is disposed).

Light-emitting material 265 is enclosed within discharge space 261 at 18 mg. The halides constituting light-emitting material 265 are given below, together with the respective concentrations expressed in mole percent:

$CeI_3$:$InI_3$:TlI:NaI=14.5:0.9:2.6:82.0 mol %

2. Dimming Characteristics

The following description relates to lamp 200, which includes arc tube 250 having the above specific structure, being operated under dimming conditions in a range defined by Wmin of 270 W and Wmax of 400 W.

FIG. 8 shows measurement results for total luminous flux, lamp efficiency, color temperature, CRI (general color rendering index), and Duv (deviation from blackbody locus× 1000) when lamp 200 is operated under dimming conditions in a lamp power range of 270 W to 400 W.

Total luminous flux, as shown in FIG. 8, fluctuates (increases/decreases) with fluctuations in lamp power, while lamp efficiency remains substantially constant (131.1 lm/W~135.0 lm/W), irrespective of changes in lamp power.

FIG. 8 reveals that color temperature also remains substantially constant, irrespective of changes in lamp power. Specifically, the difference between the color temperature (4155 K) at Wmax and the color temperature (4095 K) at Wmin is 60 K, which represents a huge improvement over the prior art.

CRI (72~78 Ra) and Duv (18~23) are both shown in FIG. 8 to be substantially constant even when lamp power is reduced, with CRI remaining at or above 72 Ra.

These measurement results reveal that with lamp 200 set to the above bulb wall loading WL, operation in an excellent state under dimming conditions is possible within a lamp power range of 270 W to 400 W, while exhibiting minimal change in lamp properties (e.g. lamp efficiency, color temperature, color rendering, etc.).

The life characteristics of the lamp under dimming conditions in a lamp power range of 270 W to 400 W are described next.

Figure 9:
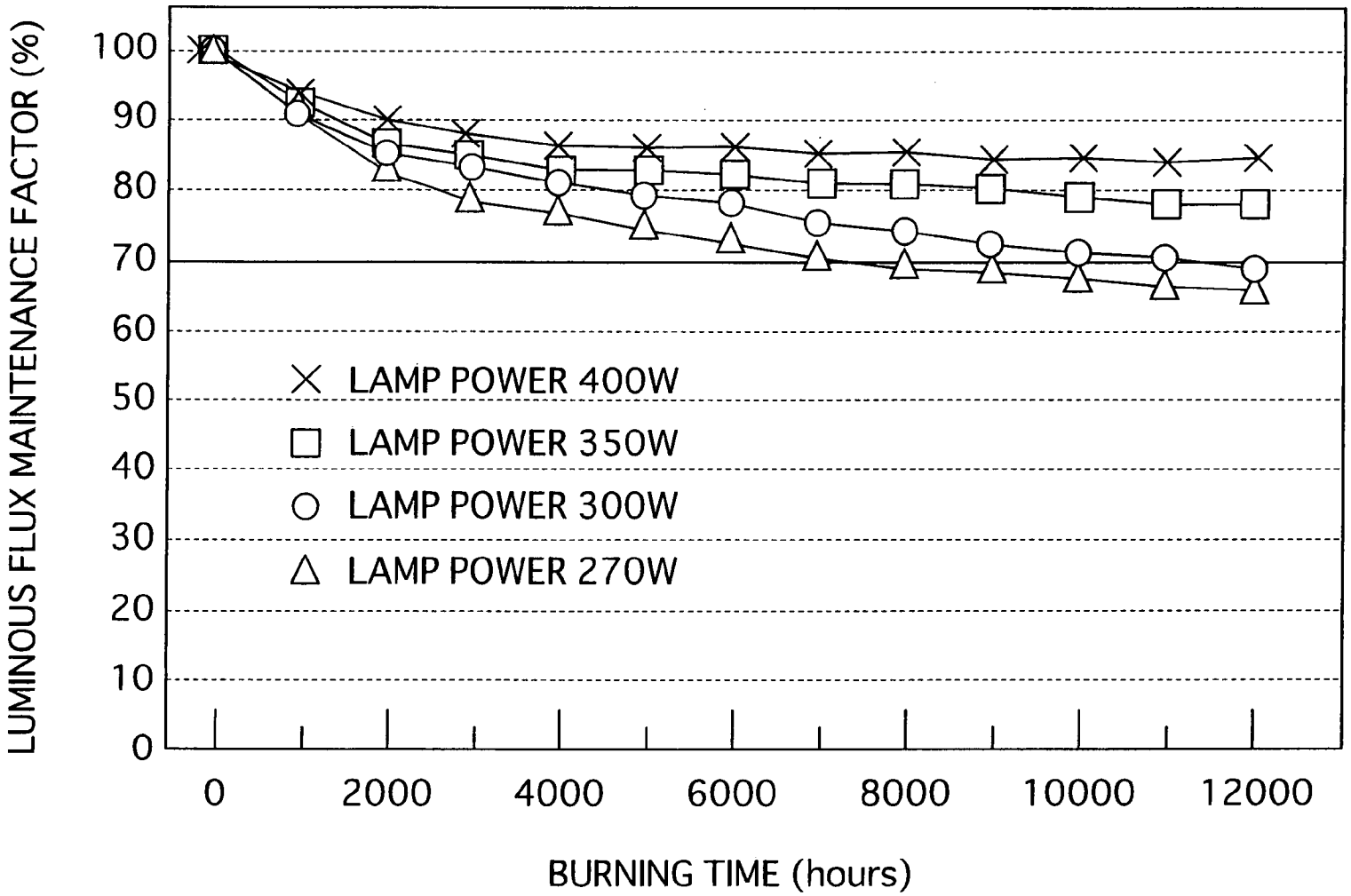
FIG. 9 shows the luminous flux maintenance factor for different lamp power values, using the lamp pertaining to embodiment 2.

FIG. 9 shows the relation between burning time and the luminous flux maintenance factor for life tests conducted at lamp power values of 270 W, 300 W, 350 W and 400 W, using lamp 200 having the above structure.

Note that the life tests were conducted as in embodiment 1, and the definition of the life characteristics and the like were also the same as embodiment 1.

As shown in FIG. 9, the test results reveal that the luminous flux maintenance factor tends to increase and life characteristics tend to improve with increases in lamp power, while the shortening of lamp life seen with conventional metal halide lamps when operated at low lamp power under dimming conditions was not observed.

The above tests show that it is possible, with lamp 200 having the above structure, to prevent changes (differences) in color temperature under dimming conditions, without changing light-emitting material 265, and, moreover, that the luminous flux maintenance factor does not decrease greatly over the entire range of lamp power values under dimming conditions. Lamp 200 is thus considered to be fully usable as a dimmable lamp.

3. Tube-wall Loading

According to the above specific description of the measurements, the bulb wall loading WL of arc tube 250 under dimming conditions is set in a range of 25 W/cm$^2$ to 37 W/cm$^2$. However, bulb wall loading WL under dimming conditions may be set in a range defined by bulb wall loading WLmin at Wmin of ≧20 W/cm$^2$ and bulb wall loading WLmax at Wmax of ≦60 W/cm$^2$, even when Wmax under dimming conditions is >250 W.

This is because the same results as embodiment 1 were obtained from conducting the tests described in section 3 of embodiment 1 on lamp 200 (i.e. the lamp of embodiment 2). For this reason a diagram showing the test results of embodiment 2 is omitted here.

Naturally, with arc tube 250, if the dimmed lighting conditions (i.e. specifically, Wmax & Wmin) are set, surface area S of the inner surface of discharge vessel 261 preferably is determined so that bulb wall loading WL satisfies the above conditions, without being limited to the above-mentioned 10.8 cm$^2$.

Note that substantially the same results are obtained for the above bulb wall loading range when nitrogen is enclosed within bulb 220 or when a vacuum is formed within the bulb.

Embodiment 3

Figure 10:
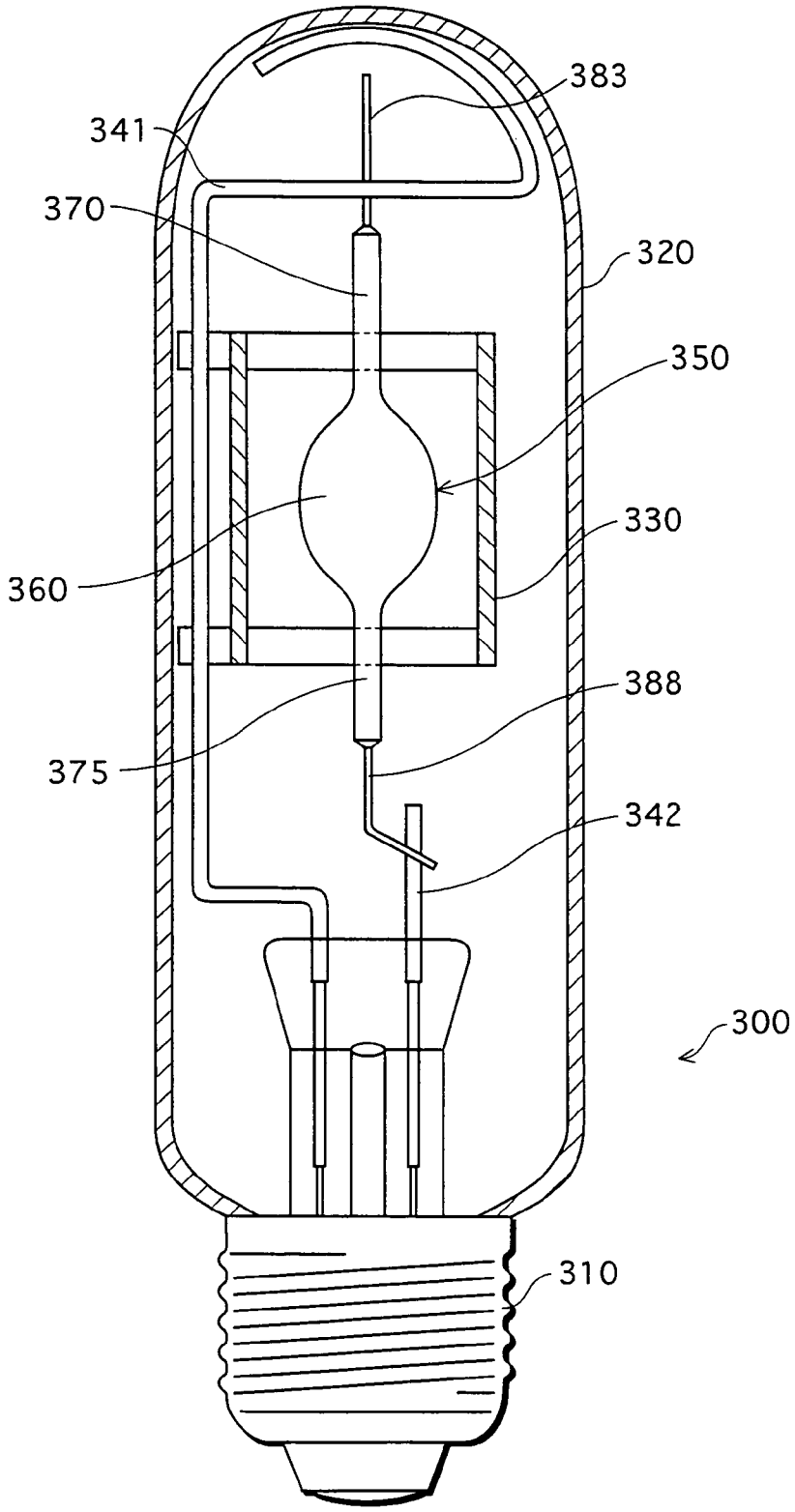
FIG. 10 is a partial cutaway view of a metal halide lamp pertaining to an embodiment 3.

FIG. 10 is a partial cutaway view of a metal halide lamp pertaining to embodiment 3.

Metal halide lamp 300 (hereinafter, simply "lamp 300") is dimmable within a lamp power range of 90 W to 150 W, and may, for example, be used as an interior light for shops, displays, exhibitions, and the like. In such applications, importance is attached to lamp efficiency and color characteristics, with a so-called white light source (CRI: ≧80, preferably ≧90; Duv: +2~−10) preferably being employed.

1. Structure

With lamp 300, as shown in FIG. 10, an arc tube 350 is held within a bulb 320 that also includes a base 310 (e.g. E26 base). As in embodiments 1 and 2, a quartz shielding tube 330 that encloses arc tube 350 is provided within bulb 320 to protect the bulb from damage. Bulb 320 is, for example, made from hard glass.

Power is fed to arc tube 350 from base 310 as a result of feeders 383 and 388, which protrude from the ends of the arc tube, being electrically connected to stem wires 341 and 342.

Arc tube 350 is described next.

As in embodiments 1 and 2, arc tube 350 includes a main tube 360 having a discharge space 361 formed therein, thin tubes 370 and 375 that extend one from either end of main tube 360, and a pair of electrode inductors.

Main tube 360 and thin tubes 370 and 375 are integrally formed from translucent polycrystalline alumina (97% total transmittance). Note that the main and thin tubes together constitute a discharge vessel, as in embodiments 1 and 2.

As shown in FIG. 10, main tube 360 is cylindrical, with the major diameter at a middle section and the diameter decreasing toward both ends. Thin tubes 370 and 375 have a straight cylindrical shape.

As in embodiments 1 and 2, electrode inductors 380 and 385 are formed from electrode rods, coils, and feeders 383 and 388. Electrode inductors 380 and 385 are partly sealed in thin tubes 370 and 375 by frit. Note that molybdenum coils are disposed in the gap between the electrode rods and thin tubes, as in embodiments 1 and 2.

Enclosed within arc tube 350 at predetermined concentrations are argon, mercury, and a light-emitting material formed from halides (e.g. $DyI_3$, $TmI_3$, $HoI_3$, $CeI_3$, TlI, NaI).

A specific example of arc tube 350 having the above structure is described next.

With arc tube 350, bulb wall loading WLmax at Wmax (here, 150 W) is set to 40 W/cm$^2$, and bulb wall loading WLmin at Wmin (here, 90 W) is set to 24 W/cm$^2$. The measurements of the discharge vessel constituting the discharge space are determined so that surface area S of the inner surface of the discharge vessel at this time is approximately 3.75 cm$^2$.

The total length of the discharge vessel is 48 mm. The outer and inner diameters of main tube 360 at the middle section are 11.4 mm and 10 mm, respectively. Thin tubes 370 and 375 each have a 3.0 mm outer diameter, a 1.0 mm inner diameter, and a 15.5 mm total length.

The principal measurements of the electrode inductors are described next. The electrode rods each have an outer diameter of 0.45 mm and a total length of 13.5 mm, while the feeders each have an outer diameter of 0.9 mm and a total length of 12 mm. Note that nitrogen is enclosed within bulb 320 at 50 kPa.

2. Lamp Characteristics

Various lamp characteristics were measured using two types of arc tubes having light-emitting material with different halide compositions. Apart from the different halide compositions, the two types of arc tubes were the same in terms of measurements and the like, for example. Note that the following compositions are expressed in mole percent.

Type 1

$DyI_3$:$TmI_3$:$HoI_3$:$CeI_3$TlI:NaI=9.6:9.6:9.5:1.8:3.7:65.7 mol %

Type 2

$DyI_3$:$TmI_3$:$HoI_3$:$CeI_3$TlI:NaI=2.1:2.1:2.1:1.3:3.9:88.5 mol %

2-1. Type 1

(a) Dimming Characteristics

The following description relates to lamp 300, which includes the type-1 arc tube, being operated under dimming conditions in a range defined by Wmin of 90 W and Wmax of 150 W.

FIG. 11 shows measurement results for total luminous flux, lamp efficiency, color temperature, CRI and Duv when the type-1 lamp is operated under dimming conditions in a lamp power range of 90 W to 150 W. Note that the data in FIG. 11 was obtained after the lamp had been operated for 100 hours.

As evident from FIG. 11, the ratio of total luminous flux (7859 lm) at lamp power of 90 W to total luminous flux (13967 lm) at lamp power of 150 W (i.e. 7859/13967=0.56) is substantially the same as the minimum to maximum lamp power ratio (i.e. specifically 90.5/147=0.62), which shows that dimmed lighting can be achieved by changing lamp power, as in embodiments 1 and 2.

Lamp efficiency at both 90 W (86.8 lm/W) and 150 W (95.4 lm/W) is high, despite the former being slightly lower than the latter.

Color temperature is substantially constant (4248 K, 4298 K), irrespective of changes in lamp power. CRI (96.4 Ra, 85.9 Ra) and Duv (−3.5, −4.0) are both substantially constant, with CRI remaining at or above 85 Ra even at low lamp power (90 W).

These measurement results reveal that with lamp 300 set to the above bulb wall loading WL (40 W/cm$^2$ and 24 W/cm$^2$ at maximum and minimum lamp power, respectively), operation in an excellent state under dimming conditions is possible within a lamp power range of 90 W to 150 W, while exhibiting minimal change in lamp properties (e.g. lamp efficiency, color temperature, color rendering, etc.). Note that the type-1 lamp also falls within the optimal bulb wall loading range under dimming conditions described in embodiment 1.

(b) Life Characteristics

The following description relates to the life characteristics of the lamp under dimming conditions in a lamp power range of 90 W to 150 W.

Figure 12:
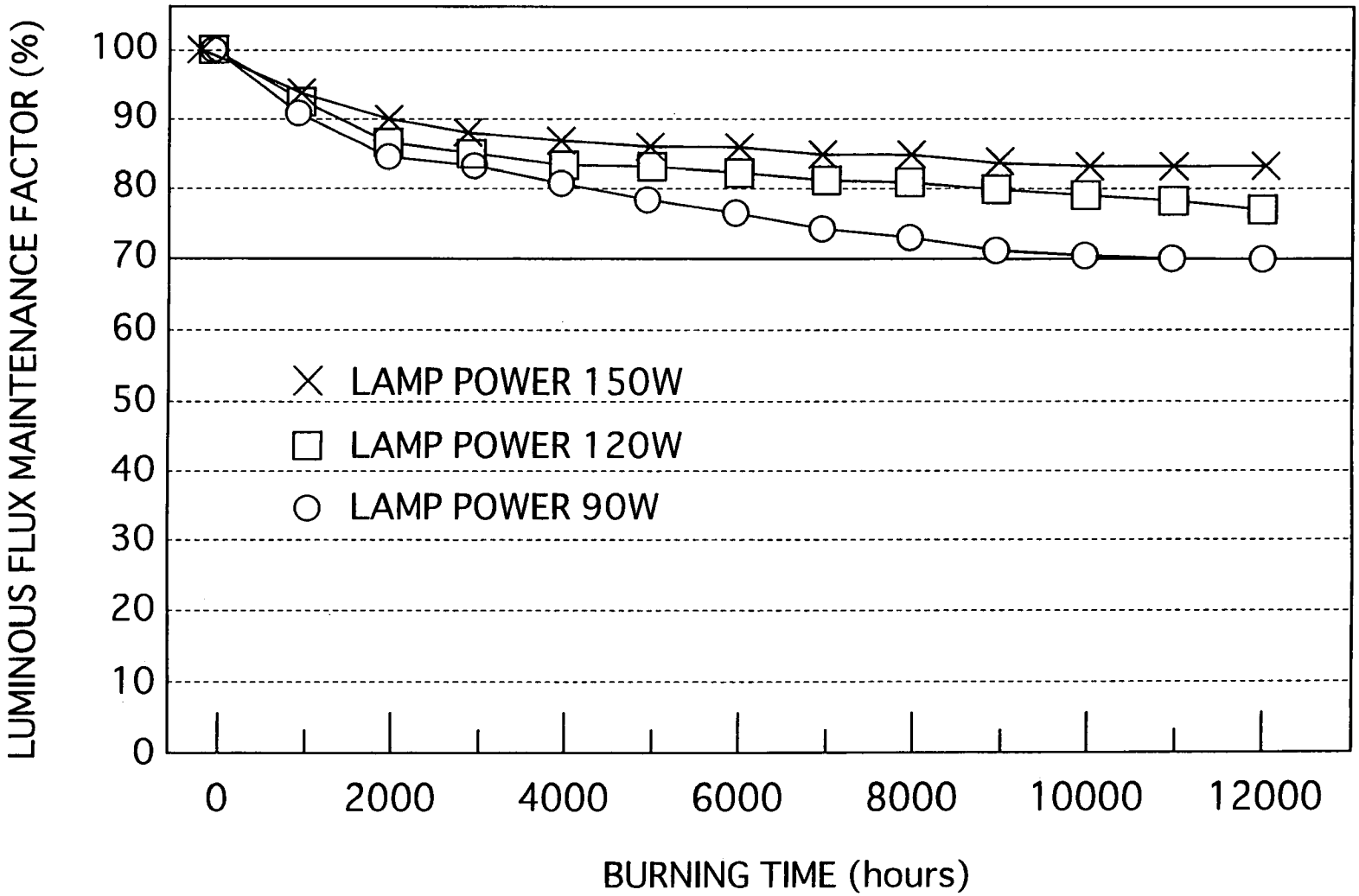
FIG. 12 shows the luminous flux maintenance factor for different lamp power values, using the lamp pertaining to embodiment 3.

FIG. 12 shows the relation between burning time and the luminous flux maintenance factor for life tests carried out at lamp power values of 90 W, 120 W and 150 W, using lamp 300 having the above structure.

Note that the life tests were conducted as in embodiment 1, and the definition of the life characteristics and the like were also the same as embodiment 1.

As shown in FIG. 12, the test results reveal that the luminous flux maintenance factor tends to increase and life characteristics tend to improve with increases in lamp power, while the shortening of lamp life seen with conventional metal halide lamps when operated at low lamp power under dimming conditions was not observed. Note that this tendency is the same as that observed in embodiments 1 and 2.

The above tests show that it is possible, with lamp 300 having the above light-emitting material composition, to prevent changes in color temperature under dimming conditions, and, moreover, that the luminous flux maintenance factor does not decrease greatly over the entire range of lamp power values under dimming conditions. Lamp 300 is thus considered to be fully usable as a dimmable lamp.

2-2. Type 2

(a) Dimming Characteristics

The following description relates to lamp 300, which includes the type-2 arc tube, being operated under dimming conditions in a range defined by Wmin of 90 W and Wmax of 150 W.

FIG. 13 shows measurement results for total luminous flux, lamp efficiency, color temperature, CRI, and Duv when the type-2 lamp is operated under dimming conditions in a lamp power range of 90 W to 150 W. Note that the data in FIG. 13 was obtained after the lamp had been operated for 100 hours.

As evident from FIG. 13, the ratio of total luminous flux (8521 lm) at lamp power of 90 W to total luminous flux (14358 lm) at lamp power of 150 W (i.e. 8521/14358=0.59) is substantially the same as the minimum to maximum lamp power ratio (i.e. specifically 90.5/147=0.62), which shows that dimmed lighting can be achieved by changing lamp power, as in embodiments 1 and 2.

Lamp efficiency at both 90 W (94.1 lm/W) and 150 W (97.7 lm/W) is high, despite the former being slightly lower than the latter.

There is a slight difference in color temperature at lamp power values of 90 W (2875 K) and 150 W (3084 K), though not enough to affect utility. There is also a slight difference in the CRI value at lamp power values of 90 W (77 Ra) and 150 W (93 Ra), although the 77 Ra CRI value at 90 W is within a permissible range. Duv (−4.0, −5.2) remains substantially constant.

3. Lamp Characteristics (a) Lamp Efficiency

FIG. 14 shows the dimming characteristics of a lamp equating to the above type-1 lamp (Hereinafter, "type-1 equivalent"). The type-1 equivalent has a color temperature of 4300 K and does not include $CeI_3$. FIG. 15, on the other hand, shows the dimming characteristics of a lamp equating to the above type-2 lamp (Hereinafter, "type-2 equivalent"). The type-2 equivalent has a color temperature of 3000 K and does not include $CeI_3$. Note that the dimming characteristics in FIGS. 14 and 15 are the characteristics of the respective lamps when operated under dimming conditions in a lamp power range of 90 W to 150 W, as in FIGS. 11 and 13.

The composition ratios (mol %) of the light-emitting material enclosed in the type-1 and type-2 equivalents were as follows:

Type-1 Equivalent $DyI_3$:$TmI_3$:$HoI_3$:TlI:NaI=10:10:10:12:58 mol %

Type-2 Equivalent $DyI_3$:$TmI_3$:$HoI_3$:TlI:NaI=2:2:2:10:83 mol %

The lamp efficiency of both the type-1 and type-2 lamps (FIGS. 11 & 13) pertaining to the present invention is above that of the type-1 and type-2 equivalents (FIGS. 14 & 15), which did not include $CeI_3$.

More specifically, the lamp efficiency of the type-1 lamp when operated at 150 W is 95.4 lm/W, whereas the corresponding value for the type-1 equivalent is 91.9 lm/W. The lamp efficiency of the type-1 lamp thus represents a 3.8% improvement over the type-1 equivalent.

Likewise, the lamp efficiency of the type-2 lamp when operated at 150 W and 90 W is 97.7 lm/W and 94.1 lm/W, whereas the corresponding values for the type-2 equivalent are 92.5 lm/W and 92.1 lm/W. The lamp efficiency of the type-2 lamp thus represents respectively a 5.6% and 2.2% improvement over the type-2 equivalent.

The above results reveal that lamp efficiency is improved when $CeI_3$ is included in the light-emitting material.

(b) Dimming Characteristics

The inventors, in addition to discovering, as noted above, that lamp efficiency is improved by the inclusion of $CeI_3$ in the light-emitting material, also noticed that changes in the $CeI_3$ concentration lead to increased variation in color temperature and Duv under dimming conditions.

In view of this, the inventors conducted investigations into the composition ratio of the light-emitting material, and succeeded in reducing the variation in color temperature and Duv while maintaining high lamp efficiency when the lamp is operated under dimming conditions, by optimizing the concentrations of cerium and thallium.

That is, excellent dimming characteristics are obtained under dimming conditions if $M_{T/C}$ satisfies $1.0 \leqq M_{T/C} \leqq 3.5$, where $M_{T/C}$ is the ratio of the TlI concentration [mol] to the $CeI_3$ concentration [mol].

The reasons for this are discussed below.

FIG. 16 shows the dimming characteristics (after 100 hrs operation) for different $M_{T/C}$ values.

Here, the different lamp types in FIG. 16 are for use at color temperatures of 3000 K and 4300 K, and the light-emitting material used in these lamps is constituted from the following halides and composition ratios.

Type 3

$DyI_3$:$TmI_3$:$HoI_3$:$CeI_3$:TlI:NaI=6.3:6.3:6.2:3.9:1.5:75.8 mol %

$M_{T/C}$=0.4

Type 4

$DyI_3$:$TmI_3$:$HoI_3$:$CeI_3$:TlI:NaI=8.4:8.4:8.3:4.1:4.1:66.1 mol %

$M_{T/C}$=1.0

Type 5

$DyI_3$:$TmI_3$:$HoI_3$:$CeI_3$:TlI:NaI=8.8:8.8:8.7:1.6:4.3:67.8 mol %

$M_{T/C}$=2.6

Type 6

$DyI_3$:$TmI_3$:$HoI_3$:$CeI_3$:TlI:NaI=2.2:2.2:2.1:1.1:3.8:88.6 mol %

$M_{T/C}$=3.5

Type 7

$DyI_3$:$TmI_3$:$HoI_3$:$CeI_3$:TlI:NaI=2.1:2.1:2.0:1.1:6.4:86.3 mol %

$M_{T/C}$=5.8

The type 3 to type 7 lamps were operated at the two lamp power values of 90 W and 150 W. Here, lamps that are operational from 90 W to 150 W may, for example, be used for interior shop lighting. In this case, preferably there is little variation in the emission color of the lamp when dimmed, and generally, a Duv differential under dimming conditions of ≦2.5 is sought for shop lighting.

From FIG. 16 we know that the Duv differential of ≦2.5 required for shop lighting is achieved when 1.0≦$M_{T/C}$ (ratio of TlI to $CeI_3$)≦3.5.

Note that while two color temperatures (3000K, 4300 K) are disclosed for the lamp types in FIG. 16, the above tendencies are thought to hold true, even for different color temperatures. Also, in the case of external lighting use, a large amount of color variation is tolerated and the Duv differential is not limited to ≦2.5. Accordingly, $M_{T/C}$ (ratio of TlI to $CeI_3$) should be suitably determined in accordance with lamp usage, output and the like, so that that the Duv differential is <7, as described in the Related Art section of this description.

(c) Related Matters

As noted above, the inventors discovered through their investigations that lamp efficiency is improved when $CeI_3$ is included in the light-emitting material, and that optimizing the $CeI_3$ and TlI concentrations helps to reduce color variation (Duv differential) under dimming conditions. In addition, the inventors also discovered that a white light source suitable for shop lighting (i.e. high lamp efficiency, high color rendering, and excellent Duv) can be obtained if the $CeI_3$ concentration is <4.0 mol % of the total halide concentration (excluding mercury).

In other words, while lamp efficiency improves when the $CeI_3$ concentration is ≧4.0 mol %, the emission intensity of the green color characteristic of cerium increases, making it difficult to obtain high color rendering and excellent Duv (+2~−10). Thus to obtain a white light source used in shop lighting and the like, $CeI_3$ preferably is enclosed at <4.0 mol %.

Variations and Related Matters

1. Lamp Power

The present invention, while having been described above based on embodiments 1 to 3, can be applied at lamp power values other than those disclosed in the preferred embodiments. The present invention is, for example, applicable in lamps that are dimmable in a range of 200 W to 300 W.

2. Light-Emitting Material

Although $DyI_3$, $TmI_3$, $HoI_3$, $CeI_3$, TlI, and NaI are used in the light-emitting material of the preferred embodiments, other halides may be used, examples of which include: praseodymium halide, cerium halide, gadolinium halide, lutetium halide, ytterbium halide, terbium halide, and erbium halide. Note that these halides do not react readily with the material constituting the discharge vessel (i.e. alumina etc.).

Also, while iodides are used as the halides in the preferred embodiments, bromides or the like may be used.

3. Concentration of Light-Emitting Material

Generally, with metal halide lamps, the lamp characteristics change depending on the concentration of light-emitting material enclosed in the discharge space. The inventors discovered, as a result of their further investigations, that when the concentration [mg] of light-emitting material with which excellent dimming characteristics are obtained is $H_{total}$, and the volume [$cm^3$] of the discharge space is V, the equation "$0.9 \leqq (H_{total}-3)/V \leqq 5.2$" preferably is satisfied for lamp operation under dimming conditions. The reasons for setting this range are discussed below.

(a) Tests

Firstly, in the tests, lamps having different concentrations of light-emitting material were prepared, and the dimming characteristics were evaluated under dimming conditions in a lamp power range of 90 W to 150 W. Note that the lamps used here have substantially the same structure as those described in embodiment 3.

(b) Lamps

With the lamps used in the tests, different halides were included at different ratios (mol %) in the light-emitting material, with the following two compositions of light-emitting material being employed (types 8 & 9).

Type 8

$DyI_3$:$TmI_3$:$HoI_3$:TlI:NaI=10:10:10:9:61 mol %

Type 9

$DyI_3$:$TmI_3$:$HoI_3$:TlI:NaI=3:3:3:7:84 mol %

(c) Concentration of Light-Emitting Material

A total of six different concentrations of light-emitting material were enclosed in the discharge space, these concentrations being 4.3 mg, 5.7 mg, 7.1 mg, 8.6 mg, 10.0 mg and 11.1 mg.

Note that the inventors derived a conversion expression applicable to the different metal halide lamps, this equation being the above "$(H_{total}-3)/V$". Converting the six different concentrations of light-emitting material using this expression gives −0.5, 0.9, 2.4, 3.8, 5.2 and 6.3.

(d) Test Results

The results for the dimming characteristics obtained from operating the type-8 and type-9 lamps having the six different concentrations of light-emitting material under dimming conditions are shown in FIGS. 17 and 18, respectively.

FIGS. 17 and 18 are described here. Firstly, the "$(H_{total}-3)/V$" column lists the converted concentrations. Note that the symbols used to evaluate the dimming characteristics obtained from operating the lamps under dimming conditions are as follows:

X bad

Δ not good (problems remain)

○ good (fully usable)

◎ excellent

FIGS. 17 and 18 reveal that for both lamp types, excellent lamp characteristics ("◎") are obtained for $(H_{total}-3)/V \geqq 3.8$, even when operated under dimming conditions. Furthermore, FIGS. 17 and 18 reveal that lamp characteristics which do not affect the utility of the lamp ("○") are obtained for $(H_{total}-3)/V \geqq 0.9$, even when operated under dimming conditions.

Lamp efficiency is considered next. For a given halide composition and composition ratio of the light-emitting material, lamp efficiency changes depending on the concentration of light-emitting material enclosed in the discharge space. Generally, this concentration is set to ≧95% of the maximum lamp efficiency obtainable using the light-emitting material.

With the halide composition for the type-8 lamps, the maximum lamp efficiency is thought to be around 91 lm/W. 95 percent of this value is approximately 86 lm/W, giving a $(H_{total}-3)/V$ value of approximately 5.2. If the $(H_{total}-3)/V$ value is increased beyond this (e.g. 6.3), lamp efficiency will end up falling below 95% of the maximum lamp efficiency.

FIG. 18 shows that similar conclusions to those for the type-8 lamp can also be drawn for the type-9 lamp. For reference purposes, note that $(H_{total}-3)/V=2.2$ for lamp 100 described in embodiment 1, and $(H_{total}-3)/V=2.0$ for lamp 200 described in embodiment 2.

4. Shape of Arc Tube

In embodiment 1, the diameter of the main tube of the arc tube decreases in a straight line from the middle toward the ends thereof, while in embodiment 2, the corresponding diameter decreases in an arc from the middle toward the ends thereof. However, the main tube may take other forms. For example, the main section and end sections may be cylindrical, with substantially the same diameter.

5. Wmin to Wmax Ratio

In embodiments 1 and 2, the ratio of minimum lamp power to maximum lamp power (i.e. Wmin/Wmax) is 0.66 and 0.675, respectively. Note that the change in lamp characteristics is particularly suppressed under dimming conditions in which there is a large difference between Wmin and Wmax (i.e. Wmin/Wmax≦0.7).

6. Arc Tube Leakage

In embodiment 1, reference was made to the leakages that may occur from the main tube of the arc tube when bulb wall loading surpasses a certain level. Leakages may also occur from other parts. Using lamp 1 of embodiment 1 as an example, leakages may occur, for instance, from where the sections of electrode inductors 180 and 185 are sealed within thin tubes 170 and 175 by frits 191 and 192 as the temperature of arc tube 150 increases.

The inventors discovered through their investigations that leakages from these sealed parts occur when the external temperature of the discharge-space end of the sections of the thin tubes corresponding to where the frit is disposed exceeds 900° C. Accordingly, these leakages can be prevented if the temperature of the discharge-space end of the sealing material (i.e. frit in the preferred embodiments) is reduced, for example, by lengthening the thin tubes so as to increase the distance between the discharge space and the sealing material.

7. Lamp

The bases described in the preferred embodiments are Edison (screw type) bases (e.g. E26 base), although other base types may be used, examples of which include single ended PG-type bases and double ended bases.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A magnesium-free metal halide lamp mounted for use in an illumination device for dimmed lighting that changes a luminous flux of the lamp by changing lamp power, comprising:

an arc tube including a translucent ceramic discharge vessel and two electrodes held in a magnesium-free discharge space that exists within the discharge vessel and has a plurality of halides enclosed therein, wherein the halides include sodium halide, cerium halide, thallium halide, and at least one halide selected from a group consisting of dysprosium halide, holmium halide, thulium halide, gadolinium halide, and erbium halide; and a base that feeds power to the electrodes from a maximum lamp power Wmax to a minimum lamp power Wmin whereby a dimmable operation of different luminous flux is realized from the lamp, wherein a surface area S [$cm^2$] of an inner surface of the discharge vessel satisfies Wmax/60≦S≦Wmin/20.

2. The metal halide lamp of claim 1, wherein 0≦Wmin/Wmax≦0.7.

3. The metal halide lamp of claim 1, wherein the discharge vessel includes a main tube and two thin tubes that extend one from each end of the main tube, the electrodes are each included within a different electrode inductor that is partly sealed in a respective one of the thin tubes by a sealing material, and a discharge-space end of a section of each thin tube corresponding to where the sealing material is disposed has an external surface temperature of ≦900° C. when the lamp is operated at Wmax.

4. The metal halide lamp of claim 1, wherein the halides are light-emitting materials other than mercury, and are enclosed within the discharge space at a concentration that satisfies $0.9 \leqq (H_{total}-3)/V \leqq 5.2$, where $H_{total}$ [mg] is the halide concentration and V [$cm^3$] is the volume of the discharge space.

5. The metal halide lamp of claim 2, wherein the halides are light-emitting materials other than mercury, and are enclosed within the discharge space at a concentration that satisfies $0.9 \leqq (H_{total}-3)/V \leqq 5.2$, where $H_{total}$ [mg] is the halide concentration and V [$cm^3$] is the volume of the discharge space.

6. The metal halide lamp of claim 1, wherein $1.0 \leqq M_{T/C} \leqq 3.5$, where $M_{T/C}$ is a ratio of the thallium halide concentration [mol] to the cerium halide concentration [mol].

7. The metal halide lamp of claim 5, wherein $1.0 \leqq M_{T/C} \leqq 3.5$, where $M_{T/C}$ is a ratio of the thallium halide concentration [mol] to the cerium halide concentration [mol].

8. The metal halide lamp of claim 1, wherein a ratio of the cerium halide concentration to the total halide concentration is ≦4.0 mol %.

9. The metal halide lamp of claim 7, wherein a ratio of the cerium halide concentration to the total halide concentration is ≦4.0 mol %.

10. The metal halide lamp of claim 1 is used as a white light source.

11. The metal halide lamp of claim 10, wherein Wmax is 150 and Wmin is 90 W.

12. A lighting method for operating a metal halide lamp under dimming conditions, that changes the luminous flux by changing lamp power, the lamp including an arc tube in which two electrodes are held facing one another within a translucent ceramic discharge vessel, comprising the steps of:

sealing a sodium halide comprising greater than 50 mol% and at least one halide selected from a group consisting of dysprosium halide, holmium halide, thulium halide, gadolinium halide, and erbium halide within a magnesium-free environment within the translucent ceramic discharge vessel;

supplying power to the electrode from a maximum lamp power Wmax to a minimum lamp power Wmin whereby a dimmable operation of different luminous flux is realized from the metal halide lamp; and providing a surface area S of an inner surface of the discharge vessel to satisfy $Wmax/60 \leqq S \leqq Wmin/20$.

13. The metal halide lamp of claim 3 wherein the two thin tubes are formed of a translucent polycrystalline alumina.

14. The metal halide lamp of claim 13 wherein the main tube is formed of a translucent polycrystalline alumina and the two thin tubes are formed integrally with the main tube.

15. The metal halide lamp of claim 14 wherein the metal halide lamp is dimmable within a lamp power range of 270 W to 400 W.

16. The metal halide lamp of claim 15 wherein the halides consist of NaI, $CeI_3$, $InI_3$ and $T_1I$ with NaI constituting greater than 50 mol%.

17. The metal halide lamp of claim 13 wherein the respective electrodes are frit sealed in the thin tubes with $Dy_2O_3$—$Al_2O_3$—$SiO_2$.

18. The metal halide lamp of claim 17 wherein respective lengths of the thin tubes are approximately equal to a length of the main tube.

19. The lighting method of claim 12 further comprising the step of dimming the metal halide lamp within a lamp power range of 270 W to 400 W.

20. The lighting method of claim 12 wherein the halides sealed within the arc tube consist of NaI, $CeI_3$, $InI_3$ and $T_1$ with NaI constituting greater than 50 mol %.

* * * * *